US005144370A

United States Patent [19]

Bares

[11] Patent Number: 5,144,370

[45] Date of Patent: Sep. 1, 1992

[54] APPARATUS FOR DETECTING THE VIBRATION OF ELECTRODE WIRES AND CANCELING THE VIBRATION THEREOF

[75] Inventor: Jan Bares, Webster, N.Y.

[73] Assignee: Xerox Corporation, Stamford, Conn.

[21] Appl. No.: 785,967

[22] Filed: Oct. 31, 1991

[51] Int. Cl.[5] ..... G03G 15/08

[52] U.S. Cl. ..... 355/247; 118/654

[58] Field of Search ..... 355/245, 261, 264, 249, 355/247, 202, 259, 263, 208; 118/647, 649, 653, 654

[56] References Cited

U.S. PATENT DOCUMENTS

| | | | |
|---|---|---|---|
| 4,868,600 | 9/1989 | Hays et al. | 355/259 |
| 4,984,019 | 1/1991 | Folkins | 355/215 |
| 5,010,367 | 4/1991 | Hays | 355/247 |

*Primary Examiner*—A. T. Grimley
*Assistant Examiner*—William J. Royer
*Attorney, Agent, or Firm*—H. Fleischer; J. E. Beck; R. Zibelli

[57] ABSTRACT

An apparatus in which a donor roll advances toner to an electrostatic latent image recorded on a photoconductive member. A plurality of electrode wires are positioned in the space between the donor roll and the photoconductive member. The electrode wires are tensioned. An electrical bias is applied to the electrode wires to detach the toner from the donor rolls so as to form a toner cloud in the space between the electrode wires and the photoconductive member. Detached toner from the toner cloud develops the latent image. Vibration of the electrode wires is detected in order to enable the vibration of the electrode wires to be substantially cancelled.

12 Claims, 3 Drawing Sheets

APPARATUS FOR DETECTING THE VIBRATION OF ELECTRODE WIRES AND CANCELING THE VIBRATION THEREOF

This invention relates generally to an electrophotographic printing machine, and more particularly concerns minimizing vibration of electrode wires used in a scavengeless developer unit.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. Scavengeless development and jumping development are two types of single component development. A scavengeless development system uses a donor roll with a plurality of electrode wires closely spaced therefrom in the development zone. An AC voltage is applied to the wires forming a toner cloud in the development zone. The electrostatic fields generated by the latent image attract toner from the toner cloud to develop the latent image. In jumping development, an AC voltage is applied to the donor roll detaching toner from the donor roll and projecting the toner towards the photoconductive member so that the electrostatic fields generated by the latent image attract toner to develop the latent image. Single component development systems appear to offer advantages in low cost and design simplicity. However, the achievement of high reliability and easy manufacturability of the system may present a problem. Two component development systems have been used extensively in many types of printing machines. A two component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two component development system may have lower operating costs than a single component development system. Clearly, two component development systems and single component development systems each have their own advantages. Accordingly, it is desirable to combine these systems to form a hybrid development system having the desirable features of each system. For example, at the Second International Conference on Advances in Nonimpact Printing held in Washington, D.C. on Nov. 4–8, 1984, sponsored by the Society for Photographic Scientists and Engineers, Toshiba described a development system using a donor roll and a magnetic roller. The donor roll and magnetic roller were electrically biased. The magnetic roller transported two component developer material to the nip defined by the donor roll and magnetic roller. Toner is attracted to the donor roll from the magnetic roll. The donor roll is rotated synchronously with the photoconductive drum. The large difference in potential between the donor roll and latent image recorded on the photoconductive drum causes the toner to jump across the gap from the toner roll to the latent image so as to develop the latent image.

It has been found that unless the toner properties and many other process parameters, such as wire tension, developer roller speed, and AC frequency are within specific latitudes, the electrode wires start to vibrate. Vibration of the electrode wires produces unacceptable print defects, generally referred to as strobing. It is believed that an essentially random combination of electrical and mechanical forces causes the electrode wires to follow the configuration of the developer roll surface until a restoring force due to wire tension prevails and if the wire snaps back. This is similar to plucking a string which produces sustained vibrations in the electrode wire. Vibrations of this type are clearly undesirable and must be compensated in order to optimize print quality. Various types of development systems have hereinbefore been used as illustrated by the following disclosures, which may be relevant to certain aspects of the present invention:

U.S. Pat. No. 4,868,600
Patentee: Hays et al.
Issued: Sep. 19, 1989

U.S. Pat. No. 4,984,019
Patentee: Folkins
Issued: Jan. 8, 1991

U.S. Ser. No: 759,362
Applicant: Bares
Filing Date: Sep. 7, 1991

The relevant portions of the foregoing disclosures may be briefly summarized as follows:

U.S. Pat. No. 4,868,600 describes an apparatus wherein a magnetic roll transports two component developer material to a transfer region. At the transfer region, toner from the magnetic roll is transferred to a donor roll. The donor roll transports the toner to a region opposed from a photoconductive surface having a latent image recorded thereon. A pair of electrode wires are positioned in the space between the photoconductive surface and the donor roll and are electrically biased to detach toner from the donor roll to form a toner powder cloud. Detached toner from the toner powder cloud develops the latent image.

U.S. Pat. No. 4,984,019 discloses a developer unit having a donor roll with electrode wires disposed adjacent thereto in a developement zone. A magnetic roller transports developer material to the donor roll. Toner particles are attracted from the magnetic roller to the donor roller. When the developer unit is inactivated, the electrode wires are vibrated to remove contaminants therefrom.

U.S. Ser. No. 759,362 discloses a donor roll which advances toner to an electrostatic latent image recorded on a photoconductive member. A plurality of electrode wires are positioned in the space between the donor roller and the photoconductive surface. The electrode wires are electrically biased to detach toner from the donor roll so as to form a toner powder cloud in the space between the electrode wires and the photoconductive surface. Detached toner from the toner cloud develops the latent image. A damping material is coated on a portion of the electrode wires. The damping material damps vibration of the electrode wires.

In accordance with one aspect of the present invention, there is provided an apparatus for developing a latent image recorded on a surface. The apparatus includes a housing defining a chamber storing at least a supply of toner therein. A donor member is spaced from the surface and adapted to transport toner to a region opposed from the surface. A tensioned electrode member is positioned in the development zone between the surface and the donor member. The electrode member is electrically biased to detach toner from the donor member so as to form a toner cloud in the development zone. Detached toner from the toner cloud develops the latent image. Means, in communication with the electrode member, are provided for detecting the vibration of the electrode member and substantially canceling vibrations of the electrode member.

Pursuant to another aspect of the present invention, there is provided an electrophotographic printing machine of the type in which an electrostatic latent image recorded on a photoconductive member is developed with toner to form a visible image thereof. The improvement includes a housing defining a chamber storing at least a supply of toner therein. A donor member is spaced from the photoconductive member and adapted to transport toner to a region opposed from the photoconductive member. A tensioned electrode member is positioned in the space between the photoconductive member and the donor member. The electrode member is closely spaced from the donor member and electrically biased to detach toner therefrom. This forms a toner cloud in the space between the electrode member and the photoconductive member with detached toner from the cloud developing the latent image. Means coupled to the electrode member, are provided for detecting the vibration of the electrode member and substantially canceling the vibration thereof.

The features of the present invention will become apparent as the following description proceeds and upon reference to the drawings, in which.

While the present invention will be described in connection with various embodiments thereof, it will be understood that it is not intended to limit the invention to these embodiments. On the contrary, it is intended to cover all alternatives, modifications, and equivalents may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
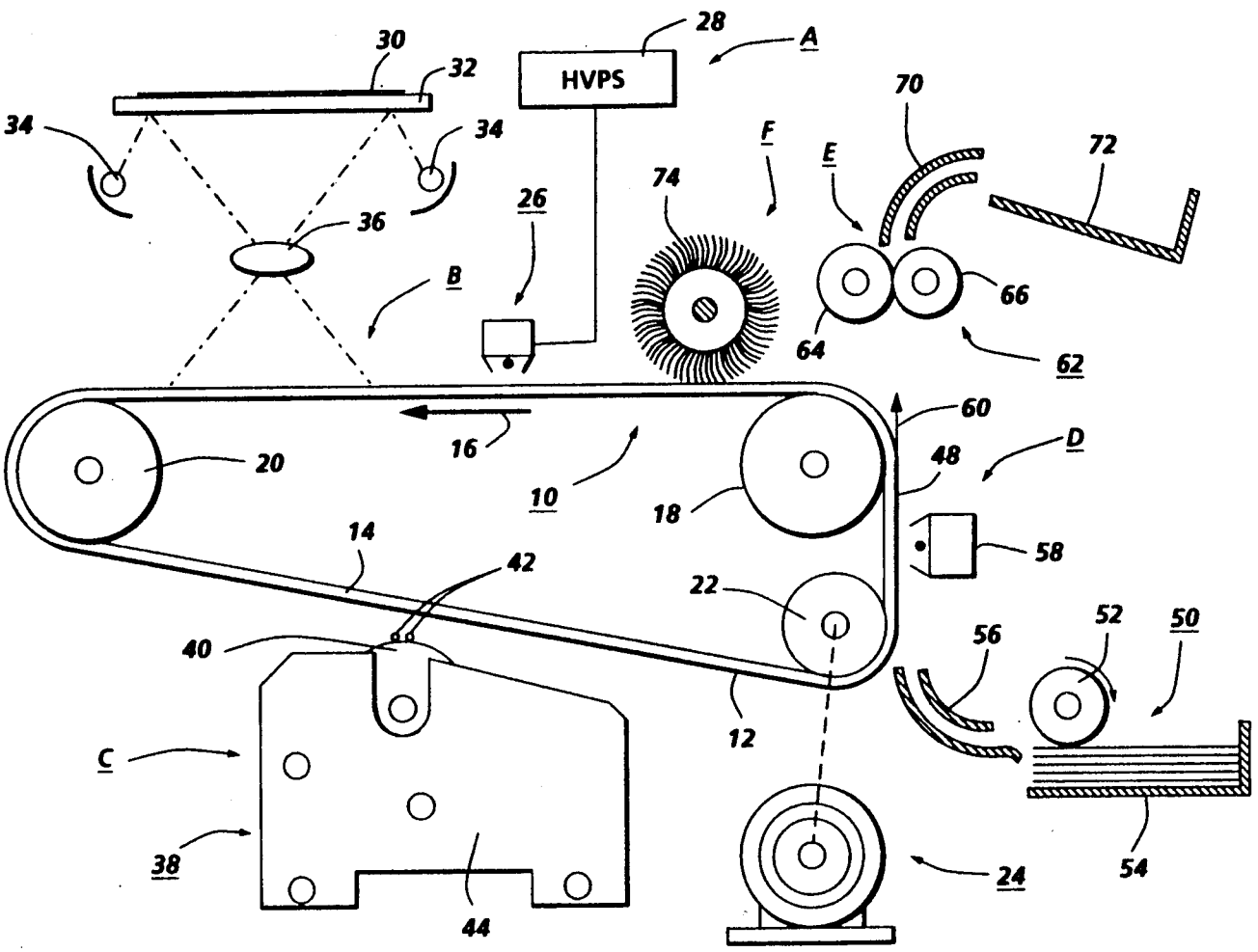
FIG. 1 is a schematic elevational view of an illustrative of electrophotographic printing machine incorporating a development apparatus having the features of the present invention therein.

Referring initially to FIG. 1, there is shown an illustrative electrophotographic printing machine incorporating the development apparatus of the present invention therein. The printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high substantially uniform potential. High voltage power supply 28 is coupled to corona generating device 26. Excitation of power supply causes corona generating device 26 to charge photoconductive surface 12 of belt 10. After photoconductive surface 12 the belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through a lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system indicated generally by the reference number 38, develops the latent image recorded on the photoconductive surface. Preferably, development system 38 includes donor roller 40 and electrode wires 42. Electrode wires 42 are electrically biased relative to donor roll 40 to detach toner therefrom so as to form a toner powder cloud in the gap between the donor roll and the photoconductive surface. The latent image attracts toner particles from the toner powder cloud forming a toner powder image thereon. Donor roller 40 is mounted, at least partially, in the chamber of developer housing 44. The chamber in developer housing 44 still has a supply of developer material. The developer material is a two component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller. The development apparatus will be discussed hereafter, in greater detail, with reference to FIG. 2.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58, which sprays ions onto the backside of sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a backup roller 66. Sheet 48 passes between fuser roller 64 and backup roller 66 with the toner image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof from the next successive imaging cycle.

It is believed that the foregoing description is sufficient for purposes of the present application to illustrate the general operation of an electrophotographic printing machine incorporating the development apparatus of the present invention therein.

Figure 2:
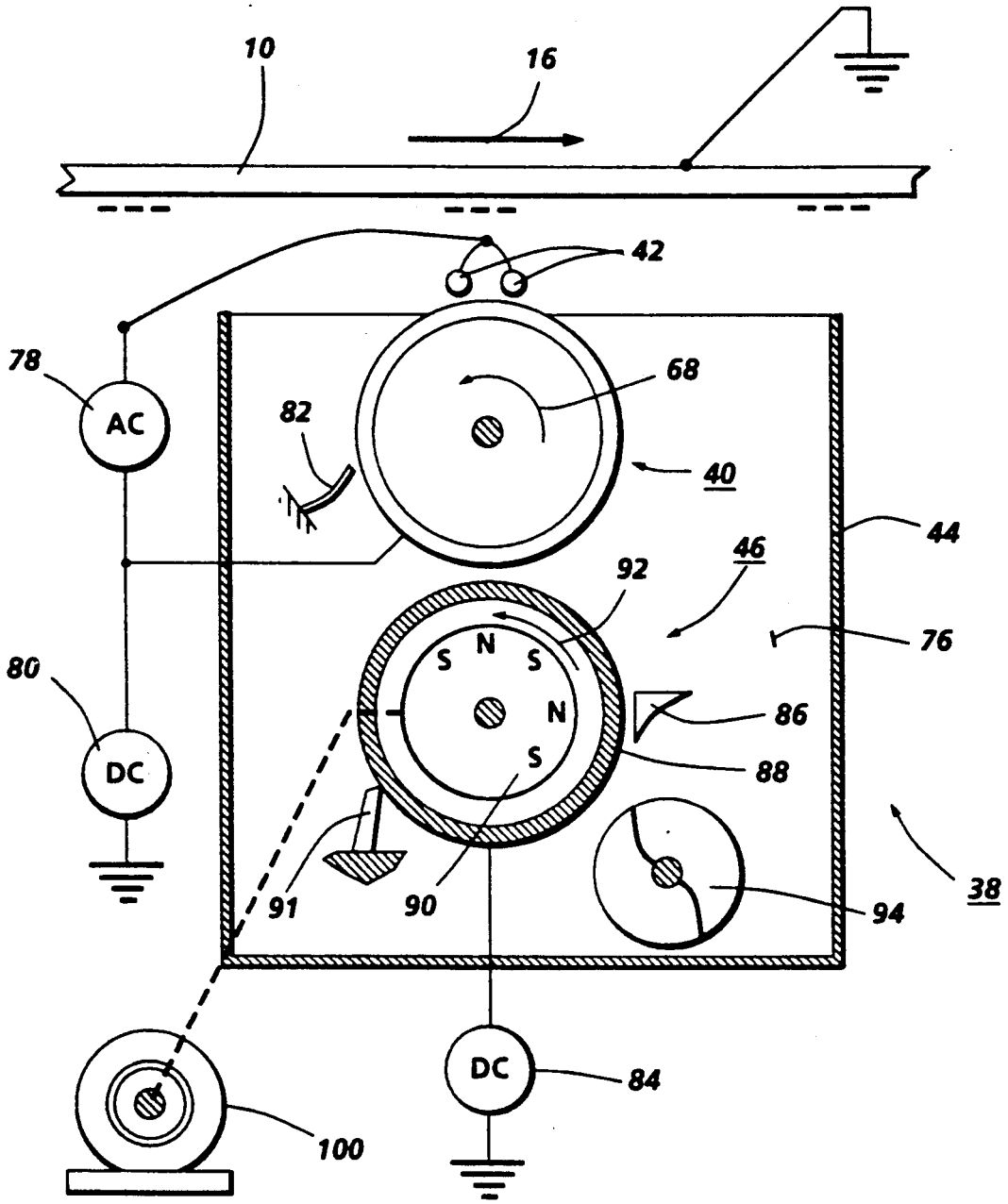
FIG. 2 is a schematic elevational view showing the development apparatus used in the FIG. 1 printing machine.

Referring now to FIG. 2, there is shown development system 38 in greater detail. As shown thereafter, development system 38 includes a housing 44 defining a chamber 76 for storing a supply of developer material therein. Toner roller 40, electrode wires 42 and magnetic roller 46 are mounted in chamber 76 of housing 44. The donor roller can be rotated in either the with or against direction relative to the direction of motion of belt 10. In FIG. 2, donor roller 40 is shown rotating in the direction of arrow 68. Similarly, the magnetic roller can be rotated in either the with or against direction relative to the direction of motion of belt 10. In FIG. 2, magnetic roller 46 is shown rotating in the direction of arrow 92. Donor roller 40 is preferably made from anodized aluminum.

Development system 38 has electrode wires 42 which are disposed into space between belt 10 and donor roller 40. A pair of electrode wires are shown extending in a direction substantially parallel to the longitudinal axis of the donor roller. The electrode wires are made from one or more thin Tungsten wires which are closely spaced from donor roller 40. The distance between the wires and the donor roller is approximately 25 microns or the thickness of the toner layer on the donor roller. The wires are self-spaced from the donor roller by the thickness of the toner on the donor roller.

With continued reference to FIG. 2, an alternating electrical bias is applied to the electrode wires by an AC voltage source 78. The applied AC voltage establishes an alternating electrostatic field between the wires and the donor roller which is effective in detaching toner from the surface of the donor roller and forming a toner cloud about the wires. The height of the cloud is such as not to be substantially in contact with belt 10. The magnitude of the AC voltage is relatively low and is in the order of 200 to 6000 volts peak at a frequency ranging from about 3 kilohertz to about 10 kilohertz. A DC bias supply 80, which applies approximately 300 volts to donor roller 40, establishes an electrostatic field between photoconductive surface 12 of belt 10 and donor roller 40 for attracting the detached toner particles from the clouds surrounding the wires to the latent image recorded on the photoconductive surface. At a spacing ranging from about 10 microns to about 40 microns between the electrode wires and the donor roller, an applied voltage of 200 to 600 volts produces a relatively large electrostatic field without risk of air breakdown. The use of the dielectric coating and electrode wires with donor roller helps to prevent shorting of the applied AC voltage. A cleaning blade 82 strips all of the toner from donor roller 40 after development so that magnetic roller 46 meters fresh toner to a clean donor roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member or sleeve 88 made preferably from aluminum and having the exterior circumferential surface thereof roughened. An elongated multi-pole magnet 90 is positioned interiorly of and spaced from the tubular member. Elongated magnet 90 is mounted stationarily. Tubular member 88 is mounted on suitable bearings and rotates in the direction of arrow 92. Motor 100 rotates tubular member 88. Developer material is attracted to tubular member 88 and advances thereabout into the nip defined by donor roller 40 and magnetic roller 46. Toner particles are attracted from the carrier granules on the magnetic roller to the donor roller. Scraper blade 91 removes denuded carrier granules and extraneous developer material from the surface of tubular member 88.

With continued reference to FIG. 2, augers, indicated generally by the reference numeral 94, are located in chamber 76 of housing 44. Augers 94 are mounted rotatably in chamber 76 to mix and transport developer material. The augers have blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles. A toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge.

Figure 3:
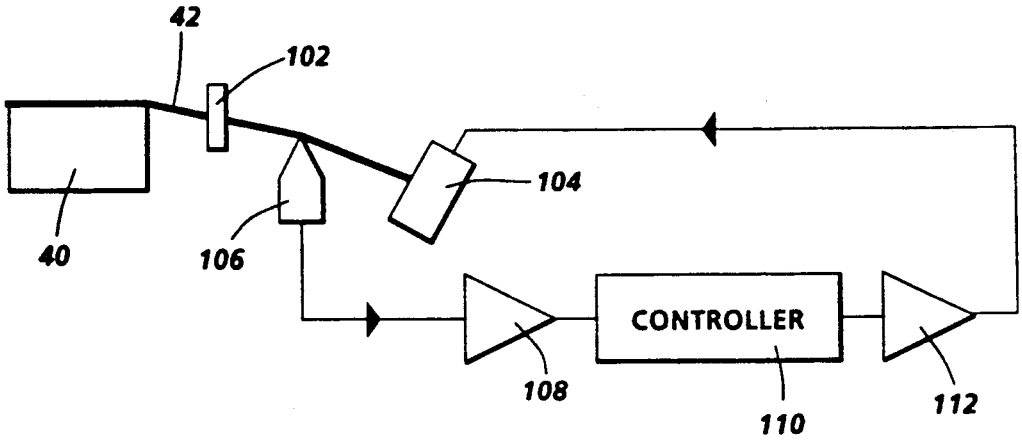
FIG. 3 is one embodiment for controlling the vibration of the electrode wires used in the FIG. 2 development apparatus.

Turning now to FIG. 3, there is shown one embodiment for controlling the vibration of wires 42. As depicted thereat, wire 42 passes around lateral pin 102. The free end of wire 42 is attached to a piezoelectric crystal 104, or an other suitable transducer, placing the wire under tension. A sensor 106 detects the vibration of wire 42. By way of example, sensor 106 may be an oscillation pickup sensor such as a microphone. The output from sensor 106 is transmitted to amplifier 108. The signal from amplifier 108 is, in turn, transmitted to controller 110. Controller 110 is a control chip deriving a control signal of appropriate amplitude and phase which is then transmitted to amplifier 112. Amplifier 112, in turn, is coupled to transducer 104. Transducer 104, i.e. the piezoelectric crystal, is excited to substantially cancel the vibrations of wire 42. An alternate embodiment of the foregoing technique, is shown in FIG. 4.

Figure 4:
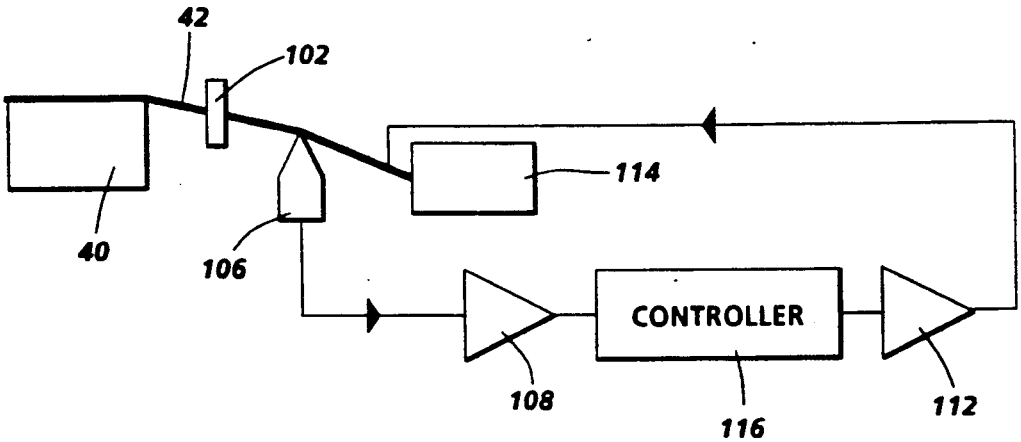
FIG. 4 is another embodiment of a technique used to control the vibration of the electrode wires used in the FIG. 2 development apparatus.

Referring now to FIG. 4, the free end of wire 42 is rigidly secured by a rigid anchor 114 placing the wire under tension. Once again, the vibrations of electrode wire 42 are detected by sensor 106. The signal from sensor 106 is transmitted to amplifier 108. Amplifier 108 generates an amplified signal which is fed to controller 116. Controller 116 is a control chip generating a driving signal of appropriate amplitude, shape, and phase. The signal from controller 116 is transmitted to amplifier 112. Amplifier 112 is connected to electrode wire 42 and supplies the driving voltage replacing the power supply 78 shown in FIG. 2. Amplifier 112 generates an AC driving voltage which has a very low base frequency, i.e. one kilohertz, to allow reasonably dense representations of harmonics, amplitudes, and phase which is controlled in real time to reduce or extinguish the vibrations of wire 42. The driving AC voltage controls the pressures of wire 42 against donor roller 40. Thus, it is necessary to control the phase of the AC voltage.

In recapitulation, it is evident that the development apparatus of the present invention includes electrode wires positioned closely adjacent the exterior surface of a donor roll. The electrode wires are in the gap between the donor roller and the photoconductive belt in the development zone. The vibration of the electrode wires is detected and substantially canceled.

It is, therefore, apparent that there has been provided in accordance with the present invention, a development system that fully satisfies the aims and advantages hereinbefore sent forth. While this invention has been described in conjunction with various embodiments thereof, it is evident that many alternatives, modifications, and variations will be apparent to those skilled in the art. Accordingly, it is intended to embrace all such alternatives, modifications, and variations that fall within the spirit and broad scoop of the appended claims.

I claim:

1. An apparatus for developing a latent image, including:

a housing defining a chamber storing at least a supply of toner therein;

a donor member spaced from a surface and adapted to transport toner to a development zone adjacent the surface;

a tensioned electrode member positioned in the space between the surface and said donor member, said electrode member being closely spaced from said donor member and being electrically biased to detach toner from said donor member so as to form a cloud of toner in the space between said electrode member and the surface with the toner developing the latent image; and means, in communication with said electrode member, for detecting the vibration of said electrode member and substantially canceling vibrations of said electrode member.

2. An apparatus according to claim 1, wherein said detecting means includes:

a sensor positioned adjacent said electrode member to detect vibrations thereof; and a controller, coupled to said sensor and said electrode member, for substantially cancelling the vibration of said electrode member in response to the vibration detected by said sensor.

3. An apparatus according to claim 2, wherein said controller includes a transducer connected to at least one end of said electrode member.

4. An apparatus according to claim 2, wherein said controller is connected to said electrode member and generates an AC driving voltage which substantially cancels the vibration of said electrode member.

5. An apparatus according to claim 4, wherein the free end of said electrode member is secured fixedly.

6. An apparatus according to claim 2, wherein said electrode member includes at least one electrode wire.

7. An electrophotographic printing machine of the type in which an electrostatic latent image recorded on a photoconductive member is developed with toner to form a visible image thereof, wherein the improvement includes:

a housing defining a chamber storing at least a supply of toner therein;

a donor member spaced from the photoconductive member and being adapted to transport toner to a region opposed from the photoconductive member;

a tensioned electrode member positioned in the space between the photoconductive member and said donor member, said electrode member being closely spaced from said donor member and being electrically biased to detach toner from said donor member so as to form a cloud of toner in the space between said electrode member and the photoconductive member with detached toner developing the latent image; and means, coupled to said electrode member, for detecting vibration of said electrode member and, in response thereto, for substantially canceling the vibration thereof.

8. A printing machine according to claim 7, wherein said detecting means includes:

a sensor positioned adjacent said electrode member to detect vibration thereof; and means, responsive to the detected vibration from said sensor, for adjusting the tension of said electrode member to substantialy cancel the vibration thereof.

9. A printing machine according to claim 8, wherein said detecting means includes:

a controller in communication with said sensor, adapted to generate a signal; and a transducer, coupled to the free end of said electrode member, said transducer being responsive to the signal from said controller for substantially canceling the vibration thereof.

10. A printing machine according to claim 8, wherein said detecting means includes a controller connected to said electrode member and said sensor, said controller generating an AC driving voltage, modified in response to the detected electrode member vibration, which substantially cancels the vibration of said electrode member.

11. A printing machine according to claim 8, further including means for advancing developer material to said donor roller.

12. A printing machine according to claim 11, wherein said electrode member includes at least one electrode wire.

* * * * *